US008371368B2

(12) United States Patent
Steele et al.

(10) Patent No.: US 8,371,368 B2
(45) Date of Patent: Feb. 12, 2013

(54) WELL ASSEMBLY WITH A MILLABLE MEMBER IN AN OPENING

(75) Inventors: David J. Steele, Arlington, TX (US); Dan Parnell Saurer, Richardson, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 121 days.

(21) Appl. No.: 12/751,343

(22) Filed: Mar. 31, 2010

(65) Prior Publication Data

US 2011/0240283 A1 Oct. 6, 2011

(51) Int. Cl.
*E21B 43/14* (2006.01)
*E21B 29/06* (2006.01)

(52) U.S. Cl. ..... 166/50; 166/380; 166/313

(58) Field of Classification Search ..... 166/50, 166/177.5, 169, 242.5, 242.6, 376, 378, 117.5, 166/313; 138/137, 140, 141, 177, 178; 175/61, 175/62
See application file for complete search history.

(56) References Cited

U.S. PATENT DOCUMENTS

| | | | | |
|---|---|---|---|---|
| 3,178,088 | A * | 4/1965 | Herr | 229/4.5 |
| 3,980,106 | A * | 9/1976 | Wiggins | 138/140 |
| 4,890,675 | A * | 1/1990 | Dew | 166/376 |
| 5,275,240 | A | 1/1994 | Peterson et al. | |
| 5,297,640 | A | 3/1994 | Jones | |
| 5,458,209 | A * | 10/1995 | Hayes et al. | 175/61 |
| 5,462,120 | A * | 10/1995 | Gondouin | 166/380 |
| 5,564,503 | A | 10/1996 | Longbottom et al. | |
| 5,579,829 | A | 12/1996 | Comeau et al. | |
| 5,615,740 | A * | 4/1997 | Comeau et al. | 166/380 |
| 5,749,605 | A | 5/1998 | Hampton et al. | |
| 5,887,655 | A * | 3/1999 | Haugen et al. | 166/298 |
| 5,944,108 | A * | 8/1999 | Baugh et al. | 166/313 |
| 6,012,526 | A * | 1/2000 | Jennings et al. | 166/298 |
| 6,012,527 | A | 1/2000 | Nitis et al. | |
| 6,041,855 | A * | 3/2000 | Nistor | 166/50 |
| 6,065,209 | A * | 5/2000 | Gondouin | 29/890.14 |
| 6,070,665 | A * | 6/2000 | Singleton et al. | 166/298 |
| 6,073,697 | A * | 6/2000 | Parlin et al. | 166/313 |
| 6,202,752 | B1 * | 3/2001 | Kuck et al. | 166/298 |
| 6,206,111 | B1 * | 3/2001 | Nistor | 175/61 |
| 6,209,644 | B1 * | 4/2001 | Brunet | 166/297 |
| 6,213,228 | B1 | 4/2001 | Saxman | |

(Continued)

FOREIGN PATENT DOCUMENTS

WO 9809053 3/1998

OTHER PUBLICATIONS

Thiele, Jr., et al., "Comparative Machinability of Brasses, Steels and Aluminum Allows: CDA's Universal Machinability Index," SAE Technical Paper 900365, Feb. 1990 (ten pages).

(Continued)

*Primary Examiner* — Brad Harcourt
(74) *Attorney, Agent, or Firm* — Kilpatrick Townsend & Stockton LLP

(57) ABSTRACT

Assemblies can be disposed in a subterranean bore. An assembly can include a body and a member that is made from a different material that the material from which the body is made. The member can be located in an opening in the body and can be coupled to the body. The member coupled to the body can define an inner diameter and form a seal for the inner diameter. The member can be milled to access an environment exterior to the member and the body for example to create a branch wellbore.

17 Claims, 7 Drawing Sheets

U.S. PATENT DOCUMENTS

| | | | | |
|---|---|---|---|---|
| 6,374,924 | B1 * | 4/2002 | Hanton et al. | 175/6 |
| 6,386,287 | B2 * | 5/2002 | George | 166/285 |
| 6,419,021 | B1 * | 7/2002 | George et al. | 166/313 |
| 6,419,026 | B1 * | 7/2002 | MacKenzie et al. | 166/381 |
| 6,533,040 | B2 * | 3/2003 | Gondouin | 166/380 |
| 6,536,525 | B1 * | 3/2003 | Haugen et al. | 166/297 |
| 6,547,006 | B1 * | 4/2003 | Kuck et al. | 166/298 |
| 6,550,550 | B2 * | 4/2003 | Hanton et al. | 175/61 |
| 6,561,279 | B2 * | 5/2003 | MacKenzie et al. | 166/381 |
| 6,766,859 | B2 * | 7/2004 | Haugen et al. | 166/313 |
| 6,811,189 | B1 | 11/2004 | DeLange et al. | |
| 6,848,504 | B2 * | 2/2005 | Brunet et al. | 166/117.5 |
| 6,868,909 | B2 * | 3/2005 | Murray | 166/298 |
| 6,913,082 | B2 * | 7/2005 | McGlothen et al. | 166/313 |
| 6,945,279 | B2 * | 9/2005 | Baba et al. | 138/137 |
| 7,025,144 | B2 * | 4/2006 | Haugen et al. | 166/313 |
| 7,025,551 | B2 * | 4/2006 | Haytayan | 411/442 |
| 7,104,324 | B2 | 9/2006 | Wetzel et al. | |
| 7,213,652 | B2 | 5/2007 | Hepburn et al. | |
| 7,225,875 | B2 | 6/2007 | Steele et al. | |
| 7,487,840 | B2 | 2/2009 | Gammage et al. | |
| 7,588,056 | B2 * | 9/2009 | Lord et al. | 138/124 |
| 7,703,524 | B2 * | 4/2010 | Parlin | 166/285 |
| 7,726,401 | B2 * | 6/2010 | Parlin et al. | 166/298 |
| 2002/0170713 | A1 * | 11/2002 | Haugen et al. | 166/298 |
| 2003/0075334 | A1 * | 4/2003 | Haugen et al. | 166/313 |
| 2003/0141063 | A1 * | 7/2003 | Haugen et al. | 166/297 |
| 2004/0011529 | A1 * | 1/2004 | McGarian et al. | 166/313 |
| 2004/0168807 | A1 * | 9/2004 | McGlothen et al. | 166/313 |
| 2004/0262006 | A1 * | 12/2004 | Dewey et al. | 166/313 |
| 2005/0145392 | A1 * | 7/2005 | Haugen et al. | 166/380 |
| 2006/0201570 | A1 * | 9/2006 | Lord et al. | 138/137 |
| 2006/0278403 | A1 * | 12/2006 | Simpson | 166/380 |
| 2006/0289156 | A1 | 12/2006 | Murray | |
| 2009/0045974 | A1 | 2/2009 | Patel | |
| 2009/0255687 | A1 * | 10/2009 | Mccullough et al. | 166/380 |
| 2009/0272537 | A1 | 11/2009 | Alikin et al. | |
| 2009/0288817 | A1 * | 11/2009 | Parlin et al. | 166/50 |
| 2009/0288829 | A1 * | 11/2009 | Parlin | 166/285 |
| 2010/0051269 | A1 | 3/2010 | Smithson et al. | |
| 2011/0186291 | A1 | 8/2011 | Lang et al. | |

OTHER PUBLICATIONS

Hilbert, et al., "Evaluating Pressure Integrity of Polymer Ring Seals for Threaded Connections in HP/HT Wells and Expandable Casing," 2004, IADC/SPE Drilling Conference (twelve Pages).

U.S. Appl. No. 12/700,448, filed Feb. 4, 2010 (thirty-seven pages).

U.S. Appl. No. 12/726,717, filed Mar. 18, 2010 (twenty-nine pages).

U.S. Appl. No. 12/750,215, filed Mar. 30, 2010 (twenty-seven pages).

U.S. Appl. No. 12/789,822, filed May 28, 2010 (fifty-three pages).

* cited by examiner

WELL ASSEMBLY WITH A MILLABLE MEMBER IN AN OPENING

TECHNICAL FIELD OF THE INVENTION

The present invention relates generally to an assembly for subterranean fluid production and, more particularly (although not necessarily exclusively), to an assembly that includes a member disposed in an opening of an assembly body, where milling the member is easier than milling the body.

BACKGROUND

Hydrocarbons can be produced through a wellbore traversing a subterranean formation. The wellbore may be relatively complex. For example, the wellbore can include multilateral wellbores and/or sidetrack wellbores. Multilateral wellbores include one or more lateral wellbores extending from a parent (or main) wellbore. A sidetrack wellbore is a wellbore that is diverted from a first general direction to a second general direction. A sidetrack wellbore can include a main wellbore in a first direction and a secondary wellbore diverted from the main wellbore and in a second general direction. A multilateral wellbore can include a window to allow lateral wellbores to be formed. A sidetrack wellbore can include a window to allow the wellbore to be diverted to the second general direction.

A window can be formed by positioning a casing joint and a whipstock in a casing string at a desired location in the main wellbore. The whipstock can deflect one or more mills laterally (or in another orientation) relative to the casing string. The deflected mills penetrate part of the casing joint to form the window in the casing string through which drill bits can form the lateral wellbore or the secondary wellbore.

Casing joints are often made from high-strength material. The high-strength material may also be non-corrosive to withstand corrosive elements, such as hydrogen sulfide and carbon dioxide, which may be present in the subterranean environment. Milling a portion of the high-strength material can be difficult and can create a large amount of debris, such as small pieces of the casing joint, that can affect detrimentally well completion and hydrocarbon production. Even casing joints having a portion of a sidewall with a smaller thickness through which a window can be milled can introduce debris, particularly if the casing joints are made from a dense, high-strength material. The debris can prevent the whipstock from being retrieved easily after milling is completed, plug flow control devices, damage seals, obstruct seal bores, and interfere with positioning components in the main bore below the casing joint.

Casing joints with pre-milled windows can be used to reduce or eliminate debris. The pre-milled windows can include a fiberglass (or aluminum) outer liner to prevent particulate materials from entering the inner diameter of the casing string. The fiberglass outer liner can be milled easily and milling the fiberglass outer liner can result in less debris as compared to drilling a window through a casing joint made from high-strength material.

The casing joint can experience high pressure in a subterranean formation. Additional support may be desired in view of the high pressure on the casing joint to prevent the fiberglass inner sleeve from collapsing or bursting. An aluminum sleeve can be provided exterior to the casing joint at the location of the window to provide the additional support.

O-rings can be provided at each end of the aluminum sleeve to provide a seal between the aluminum sleeve and the casing joint.

The aluminum sleeves and the O-rings increase the outer diameter of the casing string. In some applications, the outer diameter may be increased by one or more inches. But, an increase in outer diameter can be unacceptable in some situations.

Therefore, an assembly through which a window can be formed is desirable that can provide sufficient support for a casing string and avoid requiring an increase in the outer diameter of the casing string. An assembly that can avoid introducing an unacceptable amount of debris after the window is formed through milling is also desirable. An assembly that can be implemented with a casing joint made from a non-corrosive material is also desirable.

SUMMARY

Certain embodiments of the present invention are directed to assemblies that include a body and a member that is made from a different material that the material from which the body is made. The member can be located in an opening in the body and can be coupled or otherwise connected to the body. The member coupled to the body can define an inner diameter and form a seal for the inner diameter. The member can be milled to access an environment exterior to the member and the body for example to create a branch wellbore.

In one aspect, an assembly capable of being disposed in a bore is provided. The assembly includes a body and a member. The body can be made from a first material. It can include a wall that has an opening. The member can be disposed in the opening and coupled to the body. The member can be made from a second material that has a tensile strength that is lower than the tensile strength of the first material. At least part of the member can be milled after being disposed in the bore.

In at least one embodiment, the member can be coupled to the body by a weld connected to the first material and to the second material.

In at least one embodiment, the member can be coupled to the body by at least one of a rivet, a flange, brazing, or a bonding agent.

In at least one embodiment, the member is coupled to the body to form a seal between an inner diameter of the body and an outer diameter of the body.

In at least one embodiment, the first material is a corrosive resistant alloy.

In at least one embodiment, the second material is at least one of carbon steel or aluminum alloy.

In at least one embodiment, the assembly is one of a transition joint or a casing joint.

In at least one embodiment, the assembly includes an inner diameter and an inner sleeve. The inner diameter is defined by the body and the member. The inner sleeve is disposed in the inner diameter and adjacent to at least part of the member. The inner sleeve can prevent the member from being displaced into the inner diameter.

In at least one embodiment, the inner sleeve is coupled to the body.

In at least one embodiment, the member includes an outer diameter portion and an inner diameter portion. The outer diameter portion can be disposed exterior to the body. The inner diameter portion can be disposed in an inner diameter defined by the body and the member. The inner diameter portion and the outer diameter portion can couple the member to the body.

In one aspect, an assembly capable of being disposed in a bore is provided. The assembly includes a generally tubular body and a member. The generally tubular body includes an opening. The member is disposed in the opening and coupled to the generally tubular body. The member is a different material from the body. The member coupled to the generally tubular body defines an inner diameter and provides a seal between the inner diameter and an environment exterior to the member coupled to the generally tubular body. At least part of the member is capable of being milled after being disposed in the bore.

In another aspect, an assembly capable of being disposed in a bore is provided. The assembly includes a generally tubular body and a member. The generally tubular body is made from a first material. It includes a wall that has an opening. The member is disposed in the opening and coupled to the generally tubular body. The member is made from a second material that has a tensile strength that is lower than the tensile strength of the first material. The member coupled to the generally tubular body defines an inner diameter and provides a seal between the inner diameter and an environment exterior to the member coupled to the generally tubular body.

In at least one embodiment, the member includes a tapered surface shape.

These illustrative aspects and embodiments are mentioned not to limit or define the invention, but to provide examples to aid understanding of the inventive concepts disclosed in this application. Other aspects, advantages, and features of the present invention will become apparent after review of the entire application.

DETAILED DESCRIPTION

Figure 1:
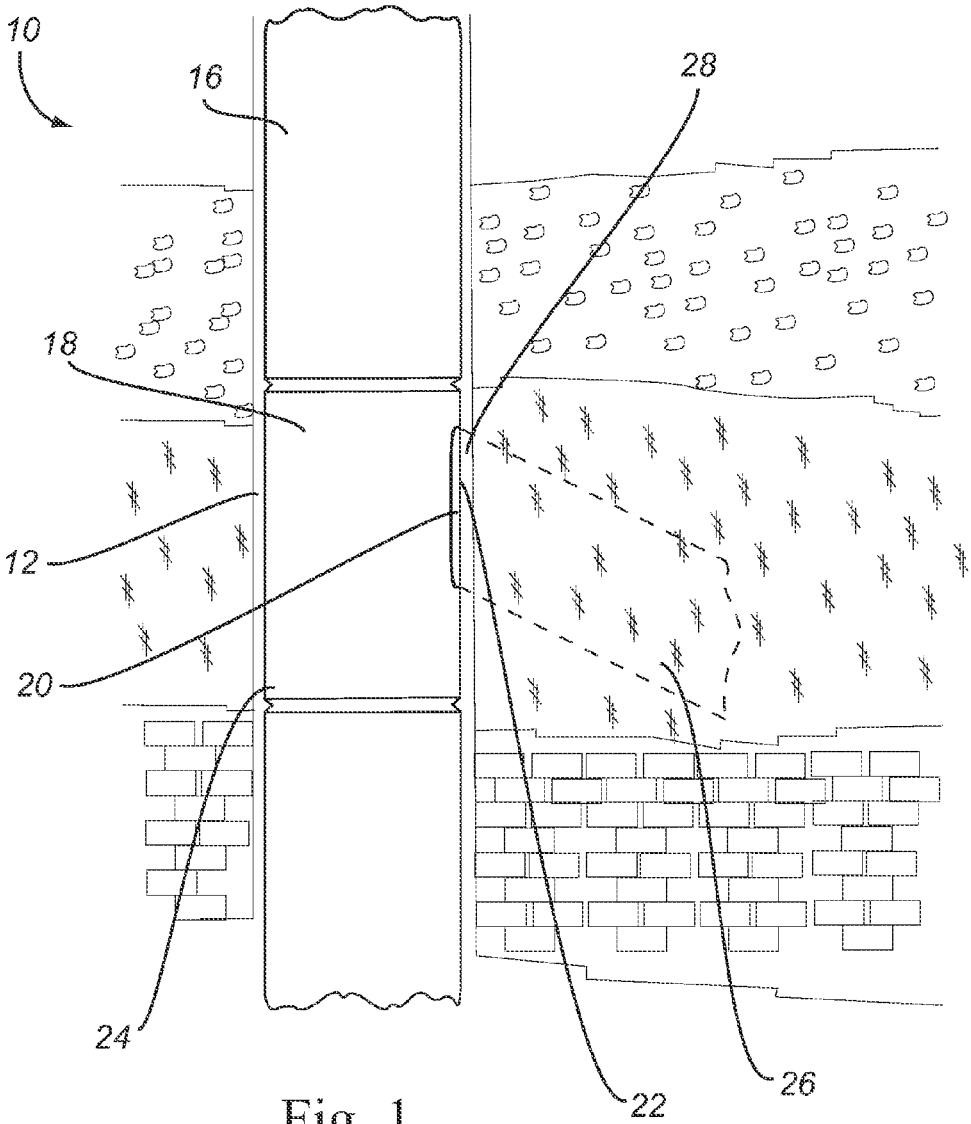
FIG. 1 is a schematic cross-sectional illustration of a well system having an assembly with a window through which a branch wellbore can be created according to one embodiment of the present invention.

Certain aspects and embodiments of the present invention relate to assemblies capable of being disposed in a bore, such as a wellbore, of a subterranean formation and through which a window can be formed. An assembly according to certain embodiments of the present invention can provide support for a casing string in a high pressure and high temperature environment of a subterranean well, while avoiding an increase in the outer diameter of the casing string and avoiding introducing a large amount of debris after the window is formed through milling. An example of a high pressure and high temperature subterranean wellbore environment is one with a pressure greater than 2500 PSI and a temperature greater than 250° F.

In some embodiments, the assembly includes components that include a body and a member that are made from different materials. The body can be made from a high-strength material that can retain its original structure and integrity for a long time in a high pressure and high temperature subterranean environment. The member can be made from a lower strength material that can retain its original structure and integrity for a shorter amount of time in the high pressure and high temperature subterranean environment and that can be milled easier than the high-strength material. For example, the material from which the member is made can have a lower tensile strength than the material from which the body is made.

The body can include a wall, such as a sidewall, with an opening that is a pre-milled window. The member can be positioned in the opening and coupled to the body. In some embodiments, the member coupled to the body defines an inner diameter and provide a seal between the inner diameter and the outer diameter of the member and the body. The seal between the inner diameter and the outer diameter provides a seal to the inner diameter from the environment in the outer diameter and to the outer diameter from the inner diameter. The seal can assist in preventing both burst and collapse.

The member can retain its general shape and integrity during positioning of the assembly in a wellbore and for at least some amount of time in the wellbore after positioning. The member can generate less debris after being milled as compared to the body. Furthermore, the member can provide less resistance to milling than the body. Accordingly, a whipstock or deflector can be positioned relative to the member in the opening of the body to deflect a mill toward the member to form a branch wellbore from a parent wellbore by milling through the member and through the subterranean formation adjacent to the member.

A "parent wellbore" is a wellbore from which another wellbore is drilled. It is also referred to as a "main wellbore." A parent or main wellbore does not necessarily extend directly from the earth's surface. For example, it could be a branch wellbore of another parent wellbore.

A "branch wellbore" is a wellbore drilled outwardly from its intersection with a parent wellbore. Examples of branch wellbores include a lateral wellbore and a sidetrack wellbore. A branch wellbore can have another branch wellbore drilled outwardly from it such that the first branch wellbore is a parent wellbore to the second branch wellbore.

These illustrative examples are given to introduce the reader to the general subject matter discussed here and are not intended to limit the scope of the disclosed concepts. The following sections describe various additional embodiments and examples with reference to the drawings in which like numerals indicate like elements and directional descriptions are used to describe the illustrative embodiments but, like the illustrative embodiments, should not be used to limit the present invention.

FIG. 1 shows a well system 10 with an assembly according to one embodiment of the present invention. The well system 10 includes a parent wellbore 12 that extends through various earth strata. The parent wellbore 12 includes a casing string 16 cemented at a portion of the parent wellbore 12.

The casing string 16 includes an assembly 18 interconnected with the casing string 16. The assembly 18 can include an opening 20 in which a member 22 is located. The member 22 can be coupled to a body 24 of the assembly 18. The assembly 18 can be positioned at a desired location to form a branch wellbore 26 from the parent wellbore 12. The desired location can be an intersection 28 between the parent wellbore 12 and the branch wellbore 26. The assembly 18 can be positioned using various techniques. Examples of positioning techniques include using a gyroscope and using an orienting profile.

Branch wellbore 26 is depicted with dotted lines to indicate it has not yet formed. To form the branch wellbore 26, a whipstock can be positioned in the inner diameter of the casing string 16 relative to the member 22 of the assembly 18 and below the intersection 28. For example, keys or dogs associated with the whipstock can cooperatively engage an orienting profile to anchor the whipstock to the casing string 16 and to orient rotationally an inclined whipstock surface toward the member 22.

Cutting tools, such as mills and drills, are lowered through the casing string 16 and deflected toward the member 22. The cutting tools mill through the member 22 and the subterranean formation adjacent to the window to form the branch wellbore 26. In some embodiments, the member 22 is made from a material that is different from the material from which the body 24 is made and that has a lower strength than the material from which the body 24 is made. The member 22 can be configured to support the assembly 18 when the assembly 18 is positioned and after positioning, without requiring an external sleeve or otherwise. Certain embodiments of the member 22 can generate less debris during milling as compared to the body 24.

Figure 2:
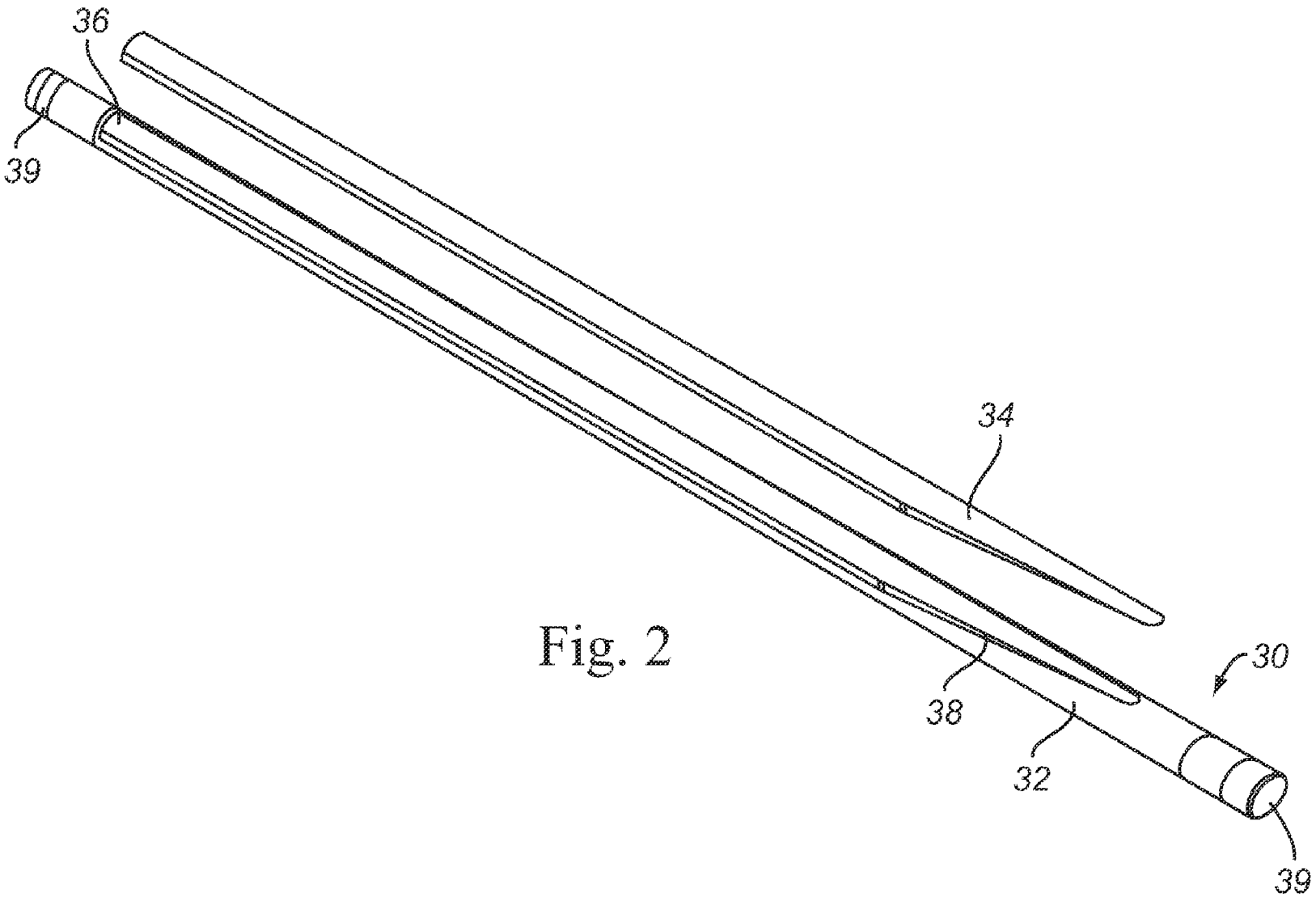
FIG. 2 is a perspective view of a decoupled body and member used to form an assembly according to one embodiment of the present invention.
Figure 3:
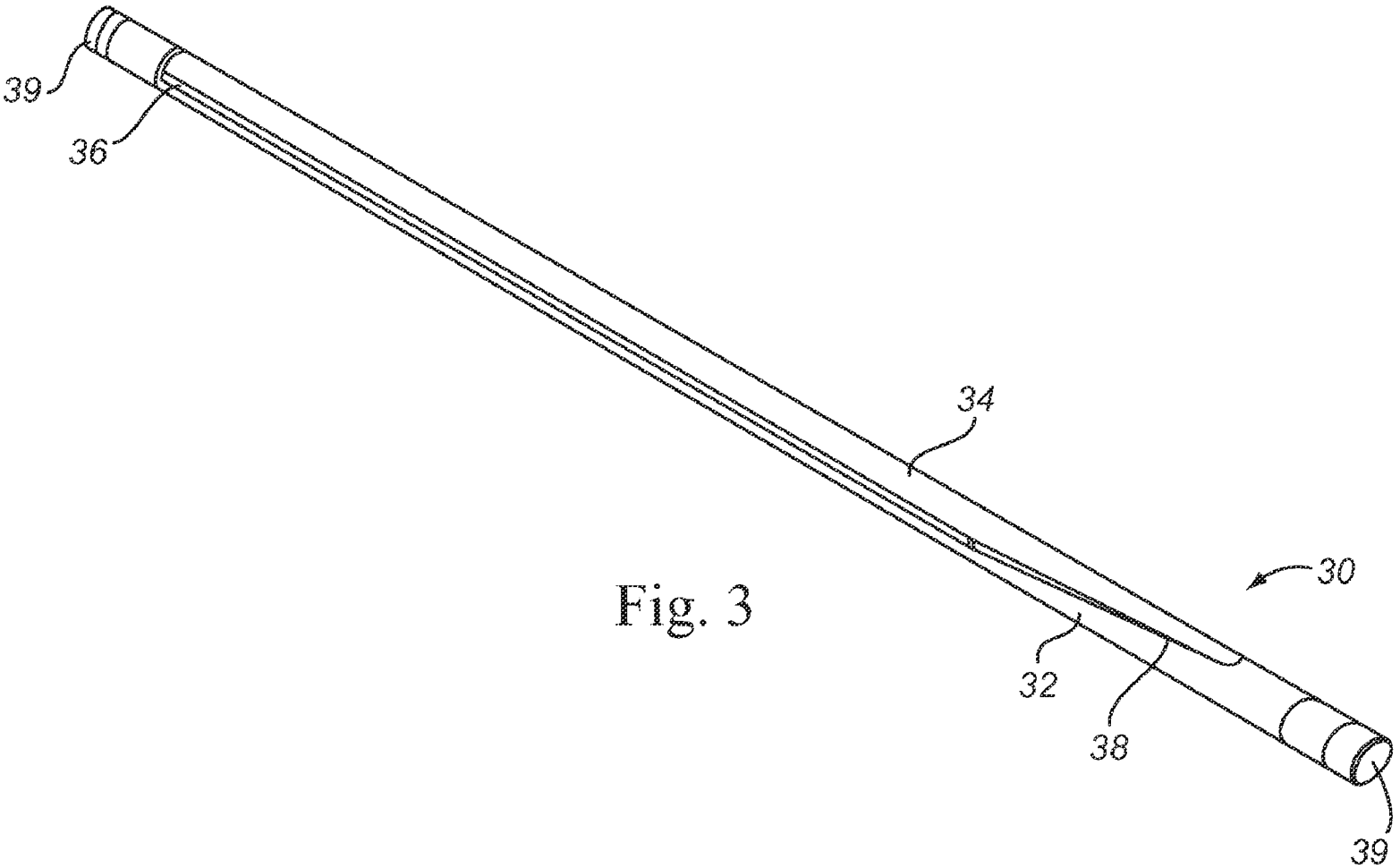
FIG. 3 is a perspective view of the assembly formed by a member coupled to a body according to one embodiment of the present invention.

Assemblies according to various embodiments of the present invention can be in any desirable configuration to support branch wellbore formation and to interconnect with a casing string. FIGS. 2 and 3 depict an assembly 30 according to one embodiment of the present invention that is capable of being interconnected with a casing string. The assembly 30 includes a body 32 that is made from a first material and includes a member 34 made from a second material that is different from the first material.

The material from which the body 32 is made can be any material capable of retaining a general shape and integrity in a subterranean wellbore environment, including a high pressure and high temperature environment. In some embodiments, the body 32 is made from a corrosion resistant alloy such as 13-chromium, 28-chromium, or other stainless steel or nickel alloy. In some embodiments, the body 32 is any material that has a corrosion resistance that is greater than the material from which the member 34 is made.

The material from which the member 34 is made can be any material that has a tensile strength that is lower than the tensile strength of the material from which the body 32 is made. In some embodiments, the material from which the member 34 is made has a hardness that is lower than the hardness of the material from which the body 32 is made. Hardness can be measured via any scale, such as Brinell hardness, Vickers hardness, and Rockwell C scale. Examples of material from which the member 34 can be made include aluminum, aluminum alloys, copper-based alloys, magnesium alloys, free-cutting steels, cast irons, carbon fiber, reinforced carbon fiber, and low carbon steel alloys, such as 1026 steel alloy and 4140 steel alloy.

The body 32 includes an opening 36 that is a window through which a branch wellbore can be formed. The opening 36 can be formed in a sidewall portion of the body 32, which is generally tubular. FIG. 2 depicts the member 34 decoupled from the body to illustrate the opening 36. FIG. 3 depicts the member 34 located in the opening 36 and coupled to the body 32. The opening 36 and the member 34 are tapered at one end 38. The tapered shape may be configured to replicate, generally, the shape created when a window is milled by a round mill deflected from a whipstock and through the member 34. The tapered shape can provide an easier path for tools to exit the window.

The member 34 can be coupled to the body 32 by any suitable devices or methods. Examples of such devices or methods include a weld, a rivet, a flange, brazing, and a bonding agent. In some embodiments, the member 34 coupled to the body 32 forms an inner diameter and seals the inner diameter from pressures that are exterior to the assembly 30 and seals the outer diameter from pressures that are interior to the assembly 30.

The body 32 also includes end components 39 capable of interconnecting the assembly 30 to a casing string. When the assembly 30 is disposed in a wellbore, a cutting tool can be deflected toward the opening 36 in which the member 34 is disposed. Because the member 34 has a lower tensile strength than the body 32, the cutting tool can be guided to the member 34 because it presents to the cutting tool a lower resistance than does the body 32. The cutting tool can mill through the member 34 and create the branch wellbore, such as a lateral wellbore or a sidetrack wellbore.

Figure 4:
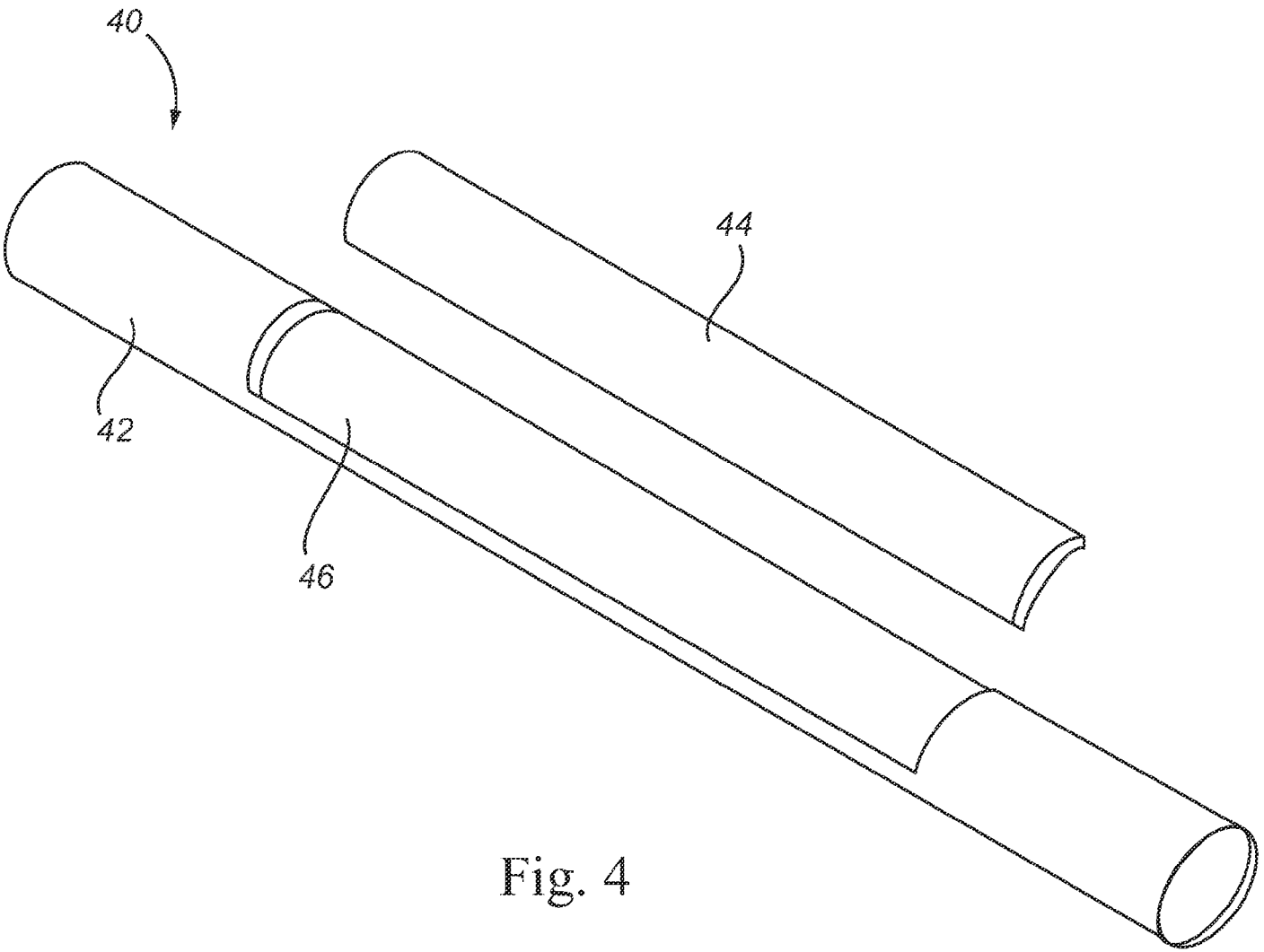
FIG. 4 is a perspective view of a member decoupled from a body of an assembly according to a second embodiment of the present invention.

FIG. 4 depicts an assembly 40 accordingly to a second embodiment of the present invention. The assembly 40 can be interconnected with a casing string and disposed in a wellbore. The assembly 40 includes a body 42 and a member 44 that is shown detached from the body 42 for illustrative purposes. The member 44 can be made from a material that is different from the material from which the body 42 is made. For example, the material from which the member 44 is made can have a tensile strength that is lower than the tensile strength of the material from which the body is made. Another criteria by which the materials can be compared is hardness. The material from which the member 44 is made can have a hardness that is lower than the hardness of the material from which the body is made. The body 42 includes an opening 46 in a sidewall portion of the body 42.

In a completed assembly, the member 44 is located in the opening 46 and is coupled to the body 42. The opening 46 and the member 44 have a semi-circular cross-section shape and a generally rectangular surface shape, instead of a tapered shape as in FIGS. 2 and 3. The semi-circular cross-section shape and generally rectangular surface shape can allow the member 44 to be coupled to the body 42 more efficiently than using the tapered shape. For example, the same size weld or other type of connection can be applied to each end of the member 44 to couple it to the body 42. In a tapered shape, a different sized weld or other connection may be needed to couple each end of a member to a body.

Assemblies are depicted as including an opening in part of a circumferential portion of a body. Assemblies according to various embodiments can include openings and members of any size and shape. In some embodiments, a body of an assembly includes an opening in an entire circumferential portion of the body and includes a member located in the opening and coupled to the body.

Figure 5:
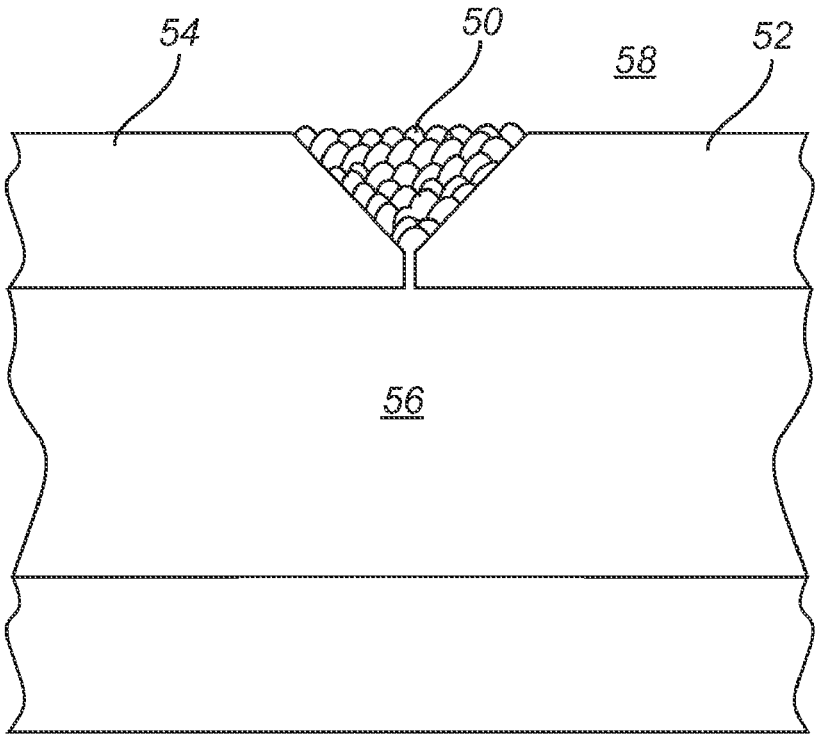
FIG. 5 is a partial cross-sectional view of a member coupled to a body using a weld according to one embodiment of the present invention.

Various types of devices or methods can be used to couple a member to a body in an assembly. FIG. 5 depicts in a partial cross-sectional view a connection that is a weld 50. A member 52 is located in an opening of a body 54. The weld 50 couples a member 52 to the body 54 to define an inner diameter 56. The member 52 coupled to the body 54 by the weld can seal the inner diameter 56 from the exterior 58 of the member 52 and body 54, such as by preventing pressure and/or temperature present in the exterior 58 from affecting the area defined by the inner diameter 56 and vice versa.

Figure 6:
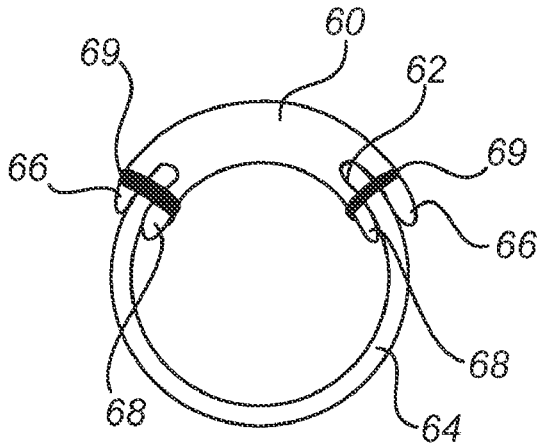
FIG. 6 is a cross-sectional view of an assembly with a member coupled to a body according to a second embodiment of the present invention.

FIG. 6 depicts a cross-sectional view of an assembly connection according to a second embodiment of the present invention. A member 60 is located in an opening 62 of a body 64. The member 60 includes outer diameter portions 66 and inner diameter portions 68. The outer diameter portions 66 overlap at least partially the outer diameter of the body 64. The inner diameter portions 68 overlap at least partially the outer diameter of the body 64. A connector 69 couples the outer diameter portions 66 to the inner diameter portions 68 and the body 64 to couple the member 60 to the body 64. In some embodiments, the member 60 coupled to the body 64 provides a seal between the inner diameter and the outer diameter.

In other embodiments, the member 60 includes one of the outer diameter portions 66 or the inner diameter portions 68, but not both. The portions present can be coupled to the body 64 using the connector 69 or otherwise, to couple the member 60 to the body 64. Furthermore, other types of connection devices and methods, other than the connector 69 shown in FIG. 6, can be used to couple the member 60 to the body 64, whether both outer diameter portions 66 and inner diameter portions 68 are present or only one is present.

Figure 7:
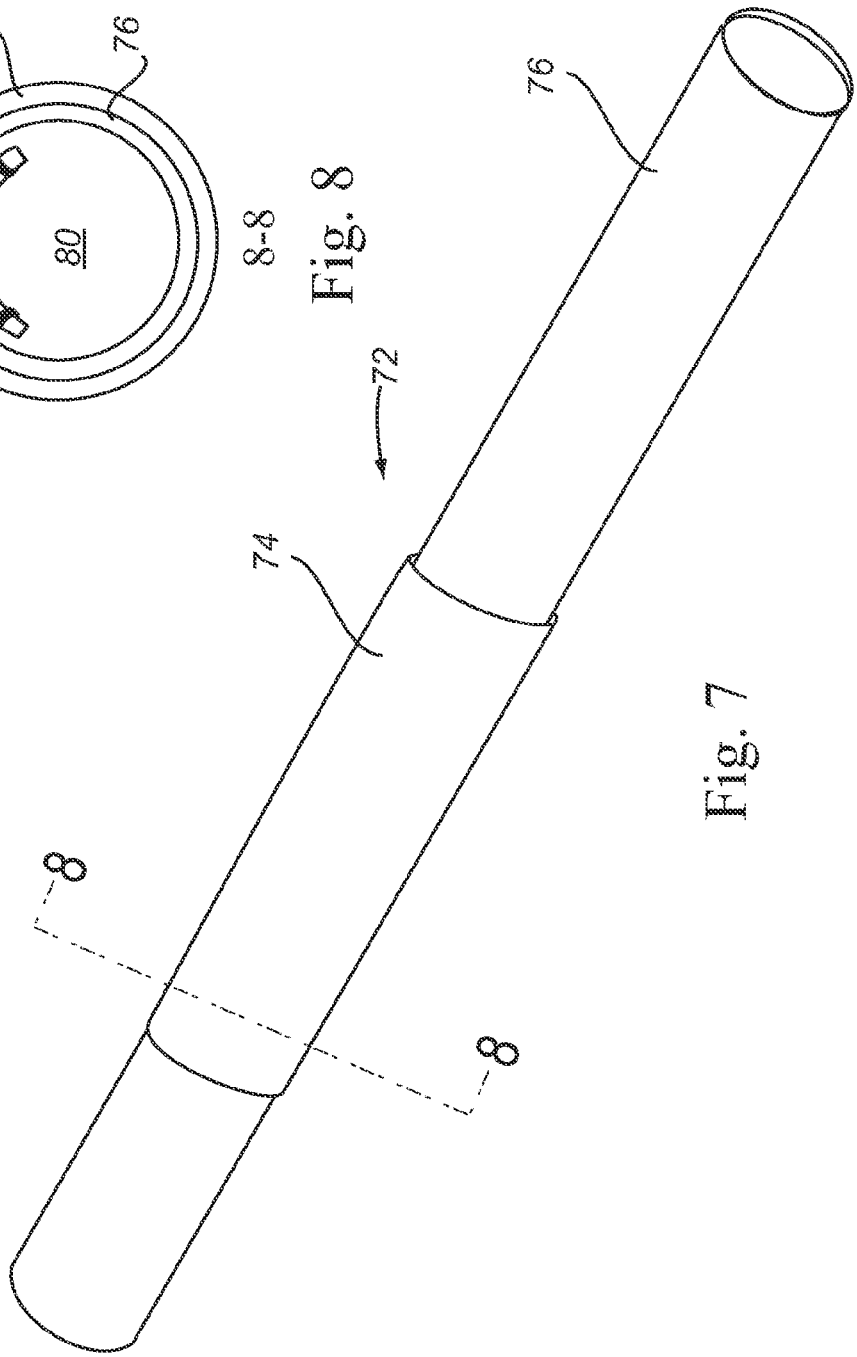
FIG. 7 is a perspective view of an assembly with a sleeve according to one embodiment of the present invention.

Various assemblies according to embodiments of the present invention can eliminate a requirement for a sleeve, liner, or other component that increases the outer diameter or the inner diameter of an assembly. Other assembly embodiments include a liner and/or sleeve to increase the strength of a member of the assembly. FIG. 7 depicts an assembly 72 that includes a sleeve 74 that is disposed exterior to a body 76 and a member (not shown) coupled to the body 76.

Figure 8:
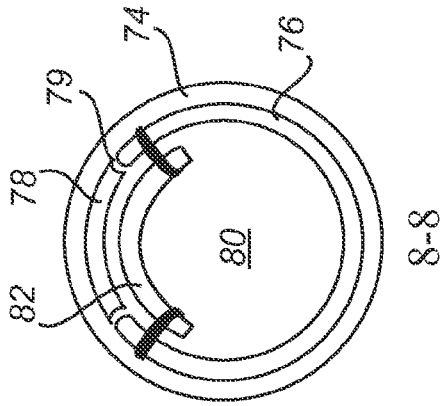
FIG. 8 is a cross-sectional view of the assembly of FIG. 7 along line 8-8 according to one embodiment of the present invention.

FIG. 8 is a cross-sectional view along line 8-8 in FIG. 7. The assembly 72 includes the member 78 located in an opening 79 of the body 76. In some embodiments, the member 78 is made from a material than has a lower tensile strength that the material from which the body 76 is made. The member 78 coupled to the body 76 define an inner diameter 80 and can provide a seal between the inner diameter 80 and an environment exterior to the member 78 coupled to the body 76. An inner sleeve 82 is disposed in the inner diameter 80 and adjacent to the member 78. The inner sleeve 82 and the sleeve 74 can provide additional support to allow the member 78 to retain its general shape and integrity during and after positioning in a wellbore. For example, the inner sleeve 82 can prevent the member 78 from being displaced into the inner diameter 80. The inner sleeve 82 and the sleeve 74 can also assist in providing a pressure seal with the inner diameter 80 and the environment exterior to the member 78 and the body 76.

The sleeve 74 and the inner sleeve 82 can be made from any suitable material. Suitable materials include aluminum and low carbon steel. Assemblies according to other embodiments, include one of a sleeve or an inner sleeve, but not both.

Figure 9:
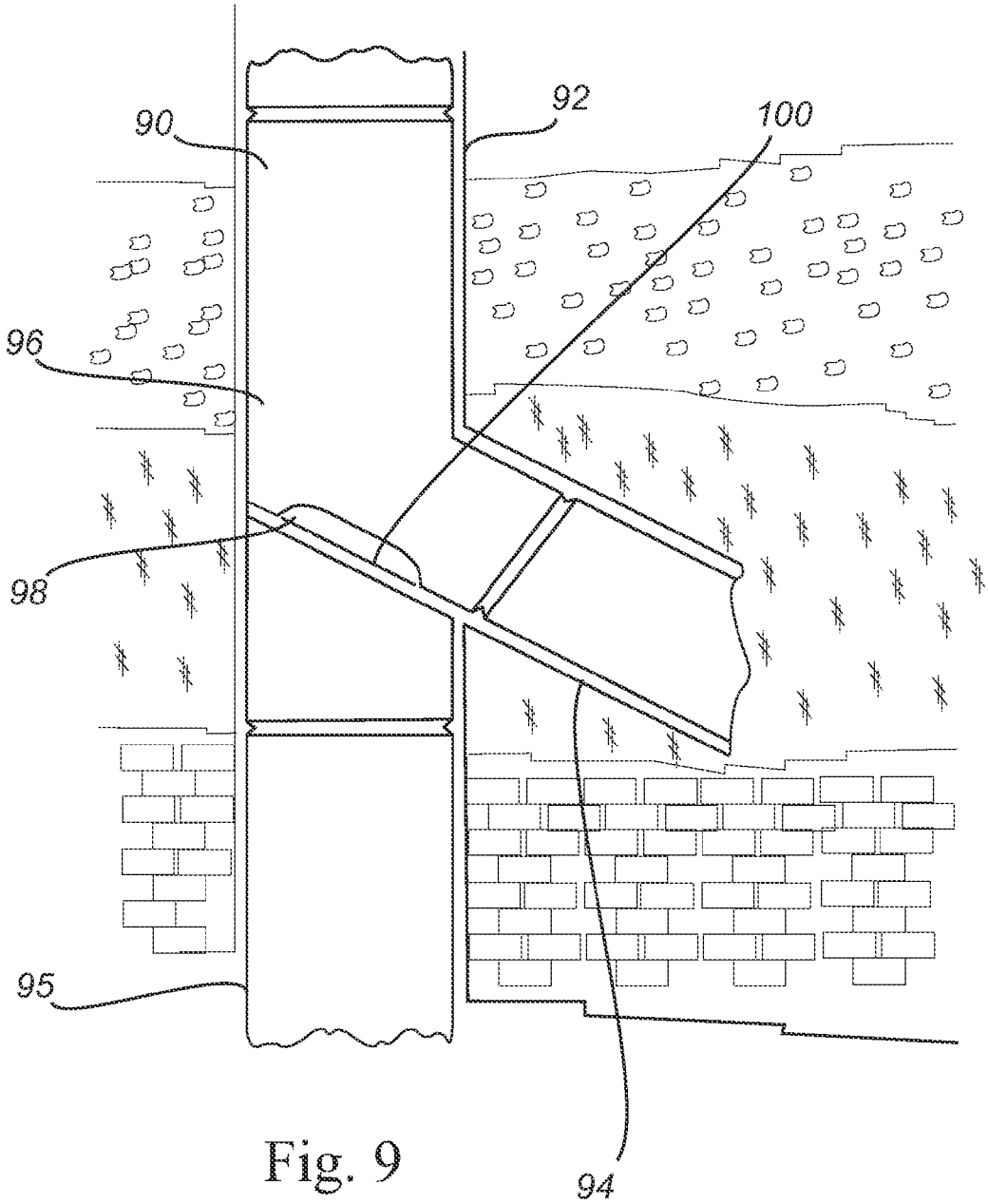
FIG. 9 is a schematic cross-sectional illustration of an assembly that is a transitional joint disposed in a well system according to one embodiment of the present invention.

Assemblies according to various embodiments of the present invention can be used as casing joints, such as the assembly depicted in FIG. 1. In other embodiments, assemblies are used in other applications to provide sufficient support in the wellbore, but reduce the amount of debris present after milling through a window. FIG. 9 depicts an assembly 90 that is a transition joint disposed in a parent bore 92 having a lateral bore 94 extending from it.

The assembly 90 can be interconnected with a casing string 95 used to mill the lateral bore 94. The assembly 90 can include a body 96 that includes an opening 98 facing a downward end of the parent bore 92. A member 100 can be disposed in the opening 98 and coupled to the body 96. The member 100 can be made from a different material from the material from which the body 96 is made. For example, the material from which the member 100 is made can have a lower tensile strength than the material from which the body 96 is made.

The member 100 can provide support to the assembly 90 during and after positioning downhole. After the lateral bore 94 is created, and completed in some embodiments, production may be desired from the parent bore 92. A cutting tool, such as a mill, can be positioned downhole and configured to cut through the member 100 located in the opening 98 of the body 96. Less debris can be created by milling the member 100 as compared to milling a portion of the body 96. After milling through the member 100, formation fluids can be produced.

The foregoing description of the embodiments, including illustrated embodiments, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

What is claimed is:

1. An assembly capable of being disposed in a bore, the assembly comprising:

a body made from a first material, the body comprising a wall having an opening in a portion of the wall; and a member disposed in the opening and coupled to the body, the member being made from a second material selected from the group consisting of carbon steel and aluminum alloy, the second material having a tensile strength lower than the tensile strength of the first material, wherein at least part of the member is capable of being milled after being disposed in the bore, wherein the member comprises an outer diameter portion and an inner diameter portion, the outer diameter portion being disposed exterior to the body, the inner diameter portion being disposed in an inner diameter defined by the body and the member, the inner diameter portion and the outer diameter portion being configured to couple the member to the body and to provide a seal between the inner diameter and an outer diameter of the body.

2. The assembly of claim 1, wherein the member is coupled to the body by a weld connected to the first material and to the second material.

3. The assembly of claim 1, wherein the member is coupled to the body by at least one of:

a rivet;

a flange;

brazing; or a bonding agent.

4. The assembly of claim 1, wherein the first material is an alloy that is more corrosion resistant than the second material.

5. The assembly of claim 1, wherein the member comprises a tapered surface shape.

6. The assembly of claim 1, further comprising:

an inner diameter defined by the body and the member;

an inner sleeve disposed in the inner diameter and adjacent to at least part of the member, the inner sleeve being configured to prevent the member from being displaced into the inner diameter.

7. The assembly of claim 6, wherein the inner sleeve is coupled to the body.

8. An assembly capable of being disposed in a bore, the assembly comprising:

a tubular body comprising an opening; and a member disposed in the opening and coupled to the tubular body, the member being a different material from the tubular body selected from the group consisting of carbon steel and aluminum alloy, the member comprising an outer diameter portion and an inner diameter portion, the outer diameter portion being disposed exterior to the tubular body, the inner diameter portion being disposed in an inner diameter defined by the member coupled to the tubular body, the inner diameter portion and the outer diameter portion being configured to couple the member to the tubular body, wherein the member coupled to the tubular body is configured to provide a pressure seal between the inner diameter and an environment exterior to the member coupled to the tubular body, wherein at least part of the member is configured for being milled after being disposed in the bore.

9. The assembly of claim 8, wherein the member has a lower tensile strength than the tubular body.

10. The assembly of claim 8, wherein the member is coupled to the generally tubular body by at least one of:

a weld a rivet;

a flange;

brazing; or a bonding agent.

11. The assembly of claim 8, wherein the tubular body is made from an alloy that is more corrosion resistant than the member.

12. The assembly of claim 8, wherein the member comprises a tapered surface shape.

13. The assembly of claim 8, further comprising:

an inner diameter defined by the generally tubular body and the member;

an inner sleeve disposed in the inner diameter and adjacent to at least part of the member, the inner sleeve being configured to prevent the member from being displaced into the inner diameter.

14. An assembly capable of being disposed in a bore, the assembly comprising:

a generally tubular body made from a first material, the generally tubular body comprising a wall having an opening in a portion of the wall; and a member disposed in the opening and coupled to the generally tubular body, the member being made from a second material selected from the group consisting of carbon steel and aluminum alloy, the second material having a tensile strength that is lower than the tensile strength of the first material, the member comprising an outer diameter portion and an inner diameter portion, the outer diameter portion being disposed exterior to the generally tubular body, the inner diameter portion being disposed in an inner diameter defined by the member coupled to the generally tubular body, the inner diameter portion and the outer diameter portion being configured to couple the member to the generally tubular body, wherein the member coupled to the generally tubular body is configured to provide a pressure seal between the inner diameter and an environment exterior to the member coupled to the generally tubular body.

15. The assembly of claim 14, wherein the member is coupled to the generally tubular body by at least one of:

a weld a rivet;

a flange;

brazing; or a bonding agent.

16. The assembly of claim 14, wherein the first material is an alloy that is more corrosion resistant than the second material.

17. The assembly of claim 14, wherein the member comprises a tapered surface shape.

* * * * *